US008616184B2

(12) United States Patent
Powell

(10) Patent No.: US 8,616,184 B2
(45) Date of Patent: Dec. 31, 2013

(54) FUEL PUMP MODULE INCLUDING A RESERVOIR HAVING MULTIPLE ZONES

(75) Inventor: Patrick Powell, Farmington Hills, MI (US)

(73) Assignees: DENSO International America, Inc., Southfield, MI (US); Denso Corporation, Kariya, Aichi-pref. (JP)

( * ) Notice: Subject to any disclaimer, the term of this patent is extended or adjusted under 35 U.S.C. 154(b) by 250 days.

(21) Appl. No.: 13/118,967

(22) Filed: May 31, 2011

(65) Prior Publication Data

US 2012/0247430 A1 Oct. 4, 2012

Related U.S. Application Data

(60) Provisional application No. 61/470,199, filed on Mar. 31, 2011.

(51) Int. Cl.
*F02M 37/00* (2006.01)
*F02M 37/04* (2006.01)

(52) U.S. Cl.
USPC ..... 123/497; 123/509

(58) Field of Classification Search
USPC ..... 123/467, 509; 417/76, 79, 80, 87
See application file for complete search history.

(56) References Cited

U.S. PATENT DOCUMENTS

| | | | | |
|---|---|---|---|---|
| 5,080,077 | A * | 1/1992 | Sawert et al. | 123/514 |
| 6,505,644 | B2 | 1/2003 | Coha et al. | |
| 6,612,458 | B2 | 9/2003 | Balzer et al. | |
| 6,619,272 | B2 * | 9/2003 | Jones et al. | 123/514 |
| 6,837,222 | B2 * | 1/2005 | Okazono et al. | 123/509 |
| 6,981,490 | B2 | 1/2006 | Nagata et al. | |
| 7,069,914 | B2 * | 7/2006 | Nagata | 123/509 |
| 7,168,416 | B2 | 1/2007 | Powell et al. | |
| 7,216,633 | B2 | 5/2007 | Attwood et al. | |
| 7,546,833 | B2 | 6/2009 | Tomomatsu et al. | |
| 2010/0037866 | A1 * | 2/2010 | Tipton et al. | 123/509 |

* cited by examiner

*Primary Examiner* — Stephen K Cronin
*Assistant Examiner* — Elizabeth Hadley
(74) *Attorney, Agent, or Firm* — Harness, Dickey & Pierce, P.L.C.

(57) ABSTRACT

A fuel pump module includes a reservoir and a sender gauge. The reservoir includes an outer wall, an inner wall spaced radially inward from the outer wall, and through-hole sockets spaced around a perimeter of the reservoir to define N zones between the inner and outer walls, where N is an integer greater than one. The sender gauge is mounted to the reservoir in one of the N zones.

23 Claims, 11 Drawing Sheets

FUEL PUMP MODULE INCLUDING A RESERVOIR HAVING MULTIPLE ZONES

CROSS-REFERENCE TO RELATED APPLICATIONS

This application claims the benefit of U.S. Provisional Application No. 61/470,199, filed on Mar. 31, 2011. The entire disclosure of the above application is incorporated herein by reference.

FIELD

The present disclosure relates to fuel pump modules, and more particularly, to fuel pump modules including reservoirs having multiple zones.

BACKGROUND

This section provides background information related to the present disclosure which is not necessarily prior art.

A fuel pump module typically includes a flange that mounts to a top surface of a fuel tank, rods that couple a reservoir to the flange, and springs around the rods that bias the reservoir against a bottom surface of the fuel tank. Various components are typically mounted to an outer wall of the reservoir, including a main pump, an auxiliary pump, and a sender gauge. Typically, the sender gauge is disposed outside of the reservoir and is oriented vertically.

Conventionally, the number of sockets included in the flange and the reservoir is equal to the number of rods coupling the reservoir to the flange. In addition, the main pump, the auxiliary pump, and the sender gauge can each only be mounted to the reservoir in a single position. Due to packaging constraints, it may be desirable to reposition the reservoir relative to the flange. In addition, it may be desirable to reposition the main pump, the auxiliary pump, and/or the sender gauge relative to the reservoir. However, repositioning the reservoir or the components mounted to the reservoir would require redesigning the fuel pump module, which would drive engineering and tooling costs.

SUMMARY

This section provides a general summary of the disclosure, and is not a comprehensive disclosure of its full scope or all of its features.

A fuel pump module includes a reservoir and a sender gauge. The reservoir includes an outer wall, an inner wall spaced radially inward from the outer wall, and through-hole sockets spaced around a perimeter of the reservoir to define N zones between the inner and outer walls. N is an integer greater than one (e.g., five). The sender gauge is mounted to the reservoir in one of the N zones.

The fuel pump module may further include an auxiliary pump disposed in one of the N zones.

The reservoir may include supports disposed in each of the N zones and may be configured to support at least one of the sender gauge and the auxiliary pump.

At least one of the sender gauge and the auxiliary pump may include a boss extending horizontally, and the supports may define slots configured to receive and retain the boss.

The auxiliary pump may be an eductor-jet pump.

The reservoir may include a prime socket disposed in one of the N zones and may be configured to contain fuel to prime the auxiliary pump. A lower end of the auxiliary pump may be disposed in the prime socket.

The through-hole sockets may include a line socket adjacent to the prime socket and may be adapted to receive a first line routed from the auxiliary pump to an auxiliary filter mounted to the reservoir at a first position in a fuel tank outside of the reservoir.

The through-hole sockets may include a rod socket configured to receive a rod coupling the reservoir to the fuel tank. The line socket may have a first inner diameter and the rod socket may have a second inner diameter that is less than the first inner diameter.

The reservoir may include a retaining feature on an outer surface of the outer wall that retains the auxiliary filter.

The auxiliary pump may include first and second tubes and a line connection in fluid communication with the first and second tubes. The upper end of the first tube may be configured to engage the first line. The upper end of the second tube may be configured to engage a second line routed to a second position in the fuel tank outside of the reservoir. The line connection may be configured to engage a third line routed to an electric pump.

The fuel pump module may further include a check valve disposed at the lower end of the auxiliary pump and may be adapted to prevent fuel flow through the auxiliary pump from the prime socket.

The fuel pump module may further include a main pump and a main filter disposed radially inward from and may be mounted to the inner wall.

The floor of the reservoir may define an inlet disposed radially inward from the inner wall.

The fuel pump module may further include a flange and a rod. The flange may be configured to mount to a top surface of a fuel tank. The flange may include flange sockets disposed around a perimeter of the flange. The rod may couple the reservoir to the flange and have one end inserted into the flange sockets and another end inserted into the through-hole sockets.

The sender gauge may include a horizontal rod at a lower end of the sender gauge and an L-shaped bracket adjacent to an upper end of the sender gauge. The L-shaped bracket may be wrapped around a top edge of the inner wall. The inner wall may include flanges engaging sides of the L-shaped bracket. The supports may define slots that support and retain the horizontal rod using a snap fit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top," "bottom," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
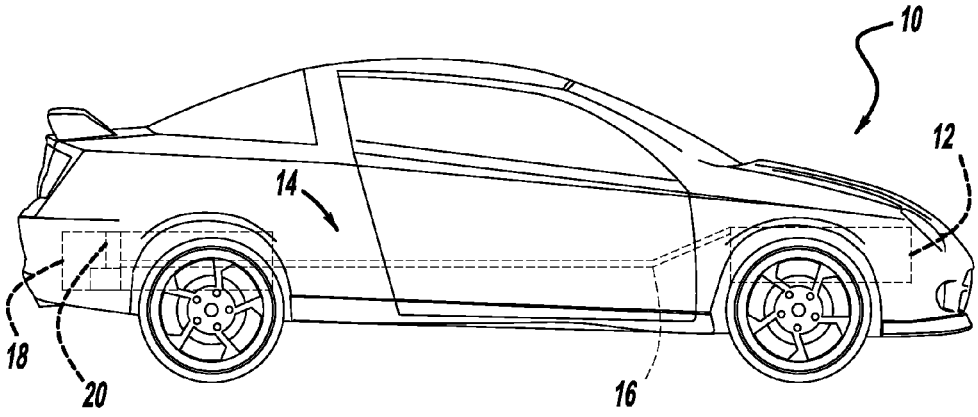
FIG. 1 is a side view of a vehicle depicting a location of a vehicle fuel system.

Referring now to FIG. 1, a vehicle 10, such as an automobile, includes an engine 12 and a fuel system 14. The fuel system 14 includes a fuel supply line 16, a fuel tank 18, and a fuel pump module 20. The fuel pump module 20 mounts within the fuel tank 18 with a flange and is normally submerged in or surrounded by varying amounts of liquid fuel within the fuel tank 18 when the fuel tank 18 contains liquid fuel. A fuel pump within the fuel pump module 20 pumps fuel to the engine 12 through the fuel supply line 16.

Figure 2:
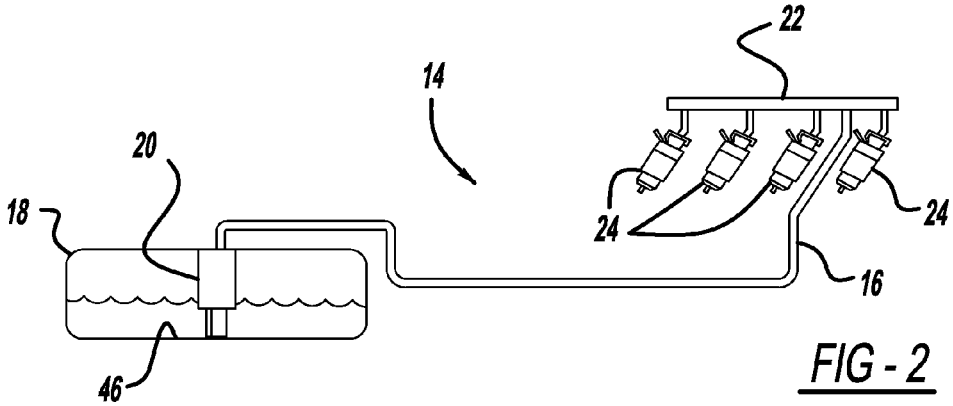
FIG. 2 is a side view of a vehicle fuel system depicting a fuel pump module within the fuel tank.

Referring now to FIG. 2, the fuel system 14 includes a fuel rail 22 and fuel injectors 24. In a returnless fuel system, only the fuel supply line 16 carries fuel between the fuel pump module 20 and the fuel rail 22. Once the fuel reaches the fuel rail 22, also called a "common rail," as depicted in FIG. 2, the fuel passes into the individual fuel injectors 24 before being sprayed or injected into individual combustion chambers of the engine 12. The fuel system 14 depicted in FIG. 2 has no fuel return line from the fuel rail 22 to the fuel tank 18. However, the fuel system 14 may be a return-type fuel system that includes a fuel return line (not shown).

Figure 3:
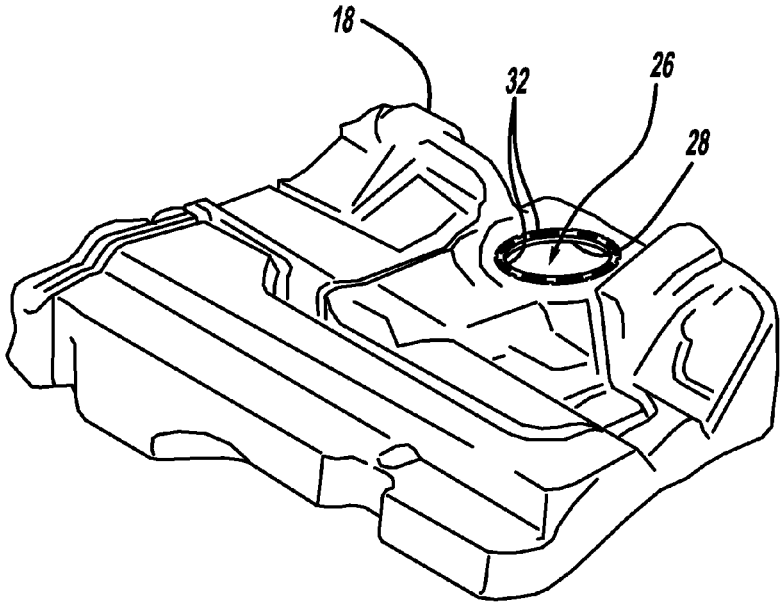
FIG. 3 is a perspective view of a fuel tank depicting an aperture for installation of a fuel pump module.
Figure 4:
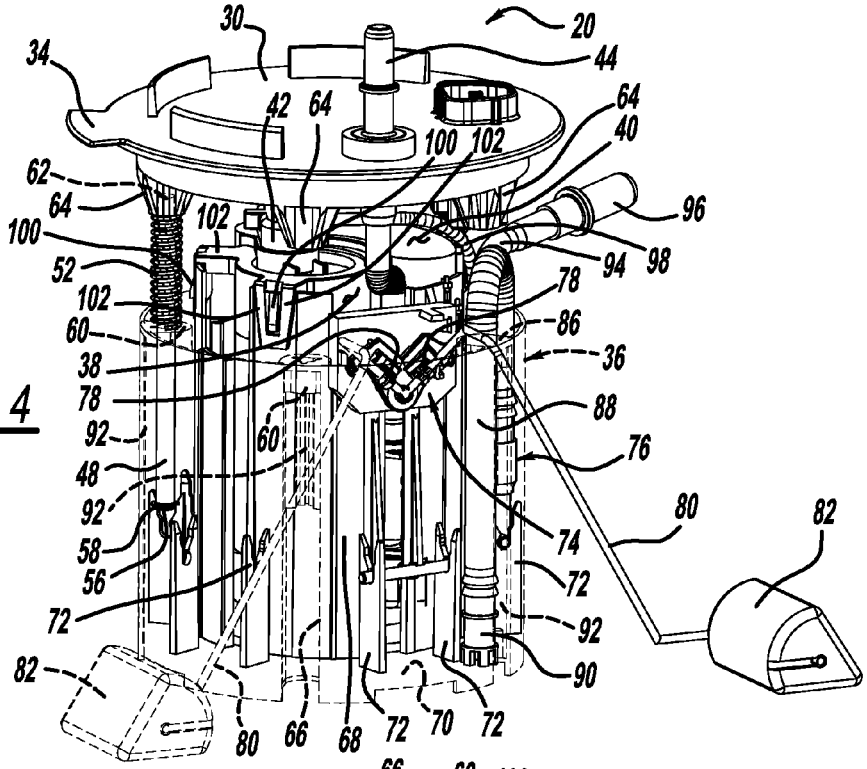
FIG. 4 is a perspective view of a fuel pump module depicting components of the fuel pump module in a first position relative to one another.
Figure 5:
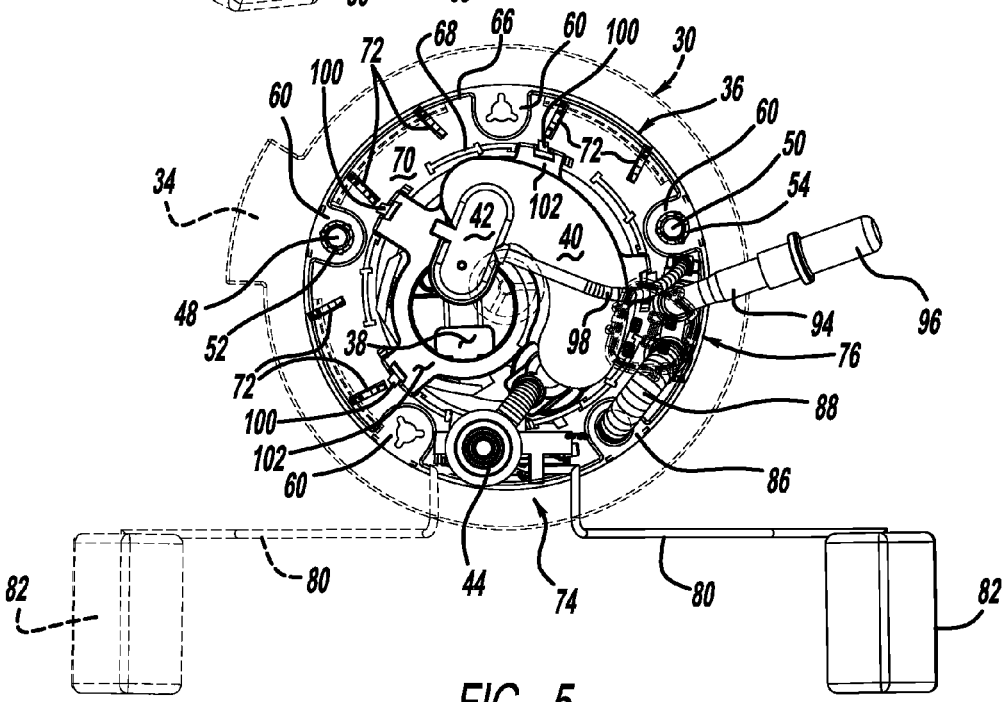
FIG. 5 is a top view of the fuel pump module of FIG. 4 depicting the components of the fuel pump module in the first position relative to one another.

With continued reference to FIG. 2, and additional reference to FIGS. 3 through 5, the fuel tank 18 has a mounting location 26, a hole, about which is a mounting surface 28 on the top of the fuel tank 18 for the fuel pump module 20. The fuel pump module 20 may be lowered through the hole of the mounting location 26 on top of the fuel tank 18 when installed. More specifically, a fuel pump module flange 30 rests on the mounting surface 28 when the fuel pump module 20 is in its installed position. The fuel tank 18 includes retaining feature 32, such as a lip, that retains the flange 30 at the mounting location 26 by, for example, engaging a tab 34 on the flange 30.

Additionally, the fuel pump module 20 includes a generally vertical cylindrical reservoir 36. Alternatively, the reservoir 36 may be oriented generally horizontally (not shown). An advantage of a horizontal reservoir is that less fuel tank depth is necessary to accommodate the reservoir. Alternatively, an advantage of a vertical reservoir is that less horizontal space is necessary for its installation and the reservoir itself may be firmly biased against the bottom interior of the fuel tank. That is, generally a vertical reservoir may have a smaller overall diameter than a horizontal reservoir for the same vehicle application.

The fuel pump module 20 includes a main pump 38, which may be an electric pump. The main pump 38 draws fuel from the reservoir 36 and through a main filter 40 and, in one example, through a check valve 42 that may be disposed at or near the top of the main pump 38. The check valve 42 opens in response to positive pressure from within the main pump 38 to permit fuel to flow from the top of the main pump 38 and into the fuel supply line 16 via a fuel supply line port 44.

To successfully pump fuel as generally described above, the fuel pump module 20 resides secured against a bottom interior surface 46 of the fuel tank 18, as shown in FIG. 2. To maintain its secured position against the bottom interior surface 46 of the fuel tank 18, the fuel pump module 20 utilizes a first rod 48 and a second rod 50. More specifically, the first rod 48 may be surrounded by a first spring 52 and the second rod 50 may be surrounded by a second spring 54. The first and second rods 48, 50 fix the fuel pump module 20 in a radial direction relative to the fuel tank 18, and the springs 52, 54 bias the fuel pump module 20 against the bottom interior surface 46 of the fuel tank 18. Because the rods 48, 50 function in the same manner, only the first rod 48 will be used to exemplify details of the disclosure.

A first end 56 of the first rod 48 may be secured to the reservoir 36 so that the first rod 48 can slide vertically relative to the reservoir 36. For example, the first end 56 may be passed through part of the reservoir 36, such as one of a plurality of rod sockets 60, and then the first end 56 may be crimped or a stop 58, such as a c-clip, may be installed at the first end 56. The crimp in the first end 56 or the stop 58 prevents the first end 56 from backing out of the one of the rod sockets 60 in which the first end 56 is passed through. A second end 62 of the first rod 48 may be secured to the flange 30 such as by a press or snap fit. For example, the flange 30 may include a plurality of rod sockets 64, and the second end 62 may be press fitted into one of the rod sockets 64.

With continued reference to FIGS. 4 and 5, and additional reference to FIGS. 6 through 9, the reservoir 36 may be repositioned relative to the flange 30 without redesigning the flange 30 or the reservoir 36. The reservoir 36 may be repositioned by inserting the rods 48, 50 into different ones of the rod sockets 60 in the reservoir 36 and into different ones of the rod sockets 64 in the flange 30. For example, in FIGS. 4 and 5, the reservoir 36 is radially aligned with the flange 30. However, in FIGS. 6 and 7, the reservoir 36 has been rotated and radially offset by a first distance relative to the flange 30. To accomplish this, the rods 48, 50 have been inserted into different ones of the rod sockets 64 in the flange 30.

Figure 8:
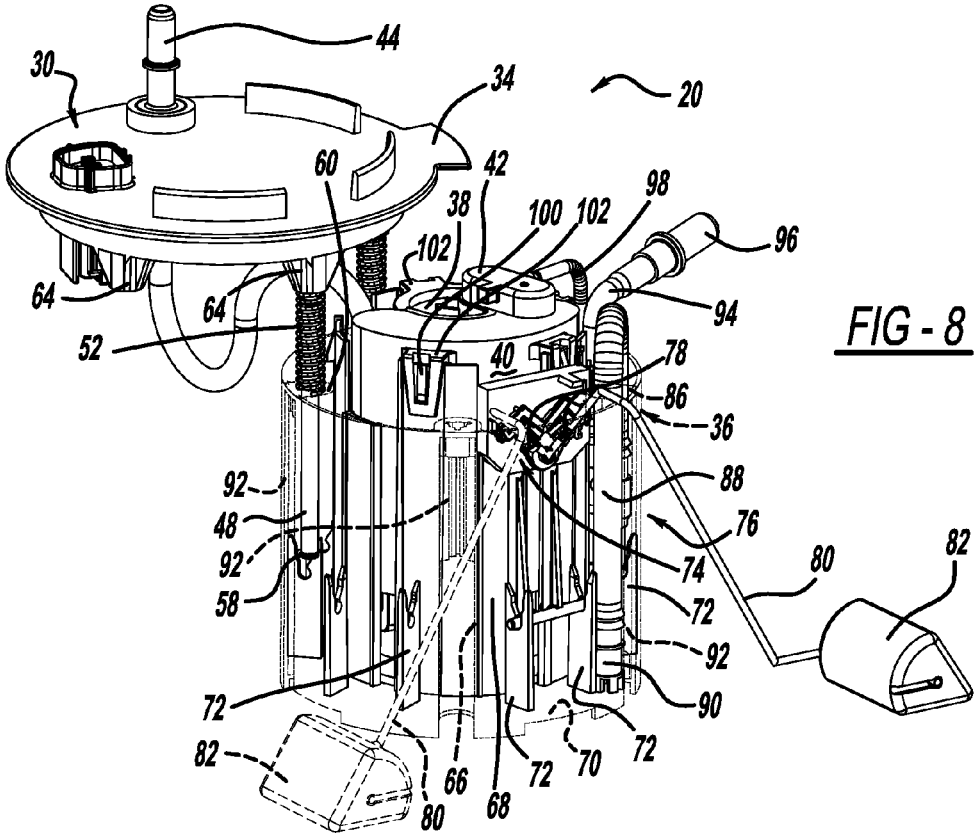
FIG. 8 is a perspective view of the fuel pump module of FIG. 4 depicting the components of the fuel pump module in a third position relative to one another.
Figure 9:
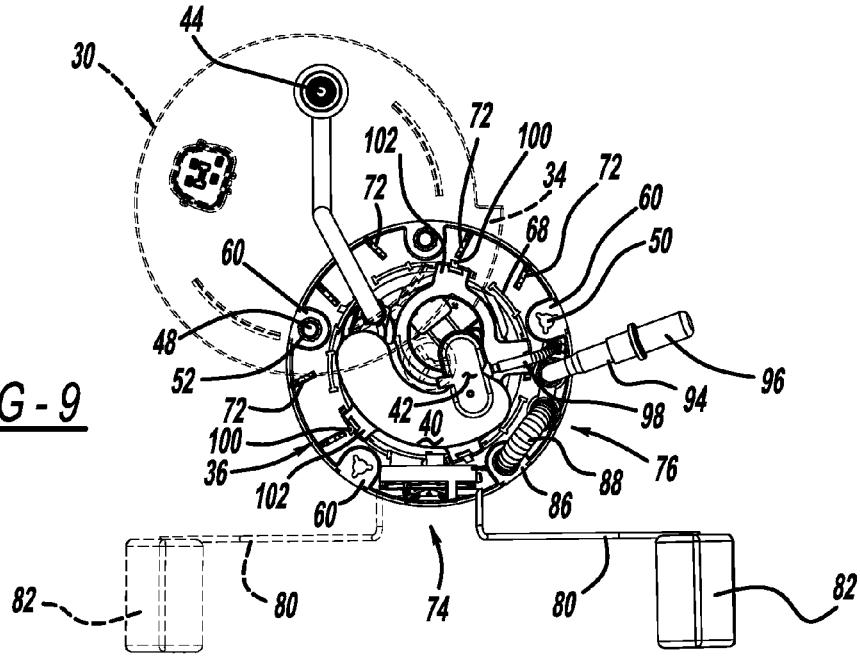
FIG. 9 is a top view of the fuel pump module of the FIG. 4 depicting the components of the fuel pump module in the third position relative to one another.

In another example, in FIGS. 8 and 9, the reservoir 36 has been rotated and radially offset by a second distance relative to the flange 30. The second distance is greater than the first distance. To accomplish this, the rods 48, 50 have been into different ones of the rod sockets 60 in the reservoir 36 and into different ones of the rod sockets 64 in the flange 30.

The reservoir 36 includes an outer wall 66, an inner wall 68 spaced radially inward from the outer wall 66, and a floor 70 connecting the outer and inner walls 66, 68. The reservoir 36 also includes multiple sets of stanchions for supports 72 disposed between the outer and inner walls 66, 68 and around the inner wall 68. The inner wall 68 divides the reservoir 36 into an inner zone contained within the inner wall 68, and an outer zone between the outer and inner walls 66, 68. The inner zone contains core components such as the main pump 38 and the main filter 40. The outer zone contains auxiliary components such as a sender gauge 74, best shown in FIGS. 4 and 8, and an auxiliary pump 76, best shown in FIG. 6. The auxiliary pump 76 may be an eductor-jet pump.

The sender gauge 74 includes arm brackets 78, an arm 80 inserted into one of the arm brackets 78, and a float 82 attached to the arm 80. The float 82 raises and lowers in response to fuel levels in the fuel tank 18 of FIG. 3. The sender gauge 74 detects fuel levels in the fuel tank 18 based on movement of the arm brackets 78, the arm 80, and the float 82. To satisfy packaging requirements, the arm 80 may be inserted into either one of the arm brackets 78. To illustrate this, the arm 80 and the float 82 are shown in a first position represented by solid lines, and the arm 80 and the float 82 are shown in a second position represented by dashed lines.

Figure 6:
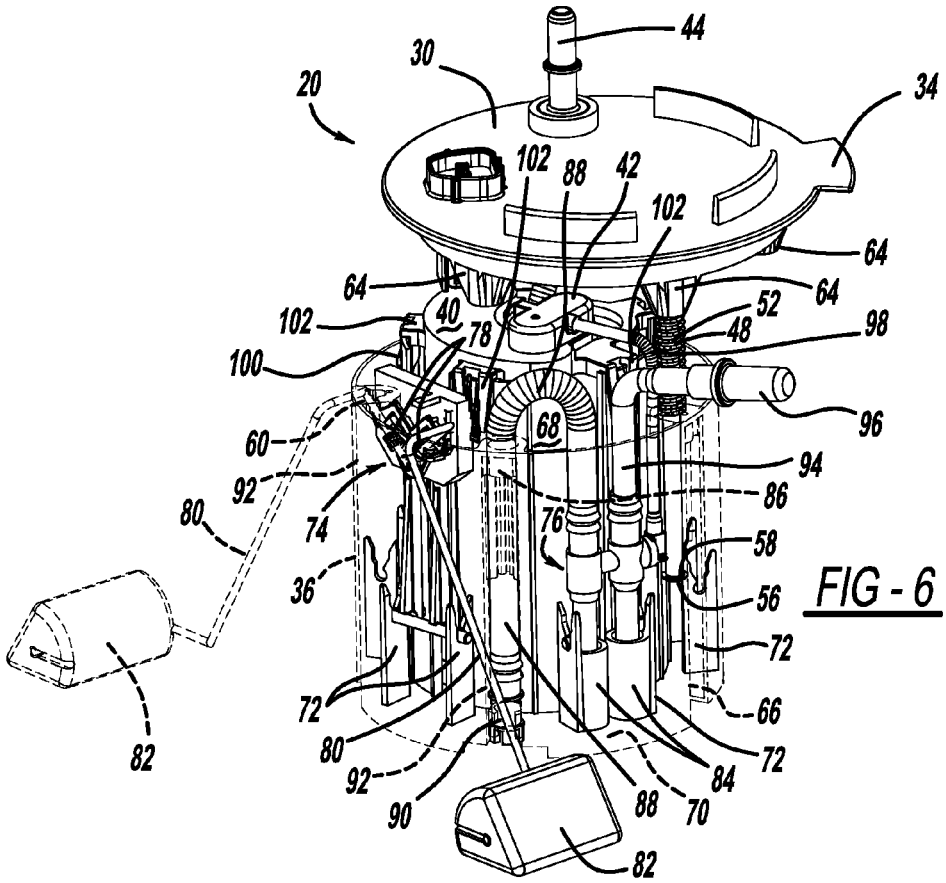
FIG. 6 is a perspective view of the fuel pump module of FIG. 1 depicting the components of the fuel pump module in a second position relative to one another.
Figure 7:
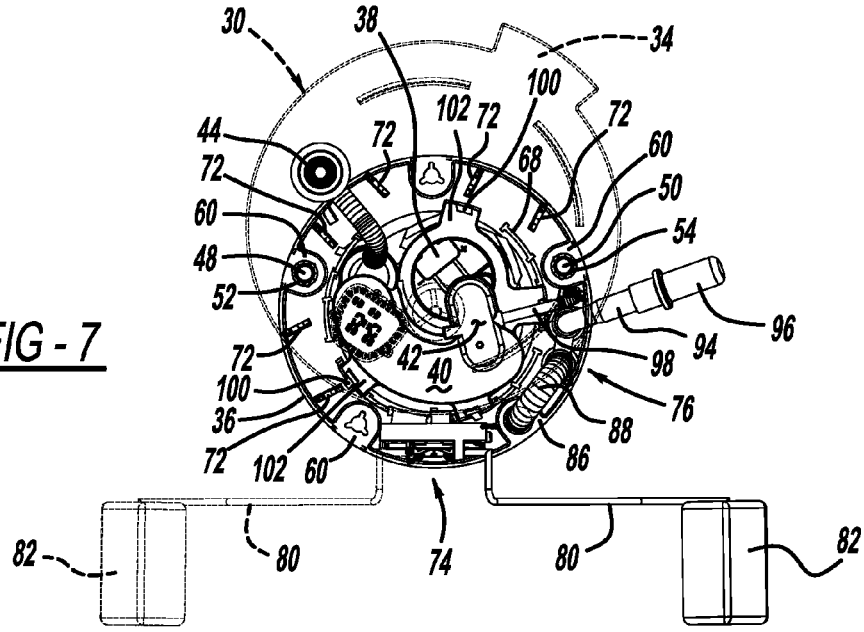
FIG. 7 is a top view of the fuel pump module of FIG. 4 depicting the components of the fuel pump module in the second position relative to one another.

With specific reference to FIG. 6, the reservoir 36 includes prime sockets 84 disposed between one of the sets of supports 72 on the floor 70 of the reservoir 36, and the outer wall 66 of the reservoir 36 defines a line socket 86. While the rod sockets 60 and the line socket 86 may be through-hole sockets, the bottom end of the prime sockets 84 may be closed by the floor 70 of the reservoir 36. The lower end of the auxiliary pump 76 is disposed in the prime sockets 84, and the upper end of the auxiliary pump 76 is connected to fuel lines routed to different positions outside of the reservoir 36 within the fuel tank 18 of FIG. 3.

A pickup line 88 is routed from the upper end of the sender gauge 74, through the line socket 86, and to a reservoir pickup or auxiliary filter 90 located in a first position outside of the reservoir 36 within the fuel tank 18. The outer wall 66 defines grooves 92 extending axially from the rod sockets 60 and the line socket 86 to the bottom of the reservoir 36. The grooves 92 may be shaped and sized to accommodate the pickup line 88 such that the outer surface of the pickup line 88 is generally flush with the outer surface of the outer wall 66. A transfer line 94 is routed from the upper end of the auxiliary pump 76 to a transfer port 96, which may be connected to a fuel line routed to a second position outside the reservoir 36 within the fuel tank 18. A feed line 98 is routed from a suction side of the auxiliary pump 76 to the check valve 42.

The main pump 38 is operable to prime the auxiliary pump 76. The main pump 38 primes the auxiliary pump 76 by drawing fuel from the prime sockets 84, through the auxiliary pump 76, and through the feed line 98 to create a vacuum within the auxiliary pump 76. In turn, the auxiliary pump 76 relies on the Venturi effect to draw fuel from the first and second positions, through the auxiliary filter 90 and the transfer port 96, through the pickup line 88 and the transfer line 94, and into the reservoir 36.

Referring again to FIGS. 4 through 9, the rod sockets 60, the line socket 86, and the grooves 92 may be equally spaced around the perimeter of the reservoir 36 to divide the outer zone into a plurality of equal zones. Although referred to as equal zones, the equal zones may be equal in size, approximately equal in size, or slightly different in size. The equal zones are defined by the outer and inner walls 66, 68 and by adjacent ones of the rod sockets 60, the line socket 86, and the grooves 92. One set of the supports 72 is disposed in each of the equal zones. The supports 72 are configured to individually support and retain the sender gauge 74 and the auxiliary pump 76. Thus, the sender gauge 74 and the auxiliary pump 76 may be mounted to the supports 72 within any one of the equal zones.

However, if the rod sockets 60 and the line socket 86 have different inner diameters, and the reservoir 36 includes only one set of the prime sockets 84, then the auxiliary pump 76 may be disposed in only one of the equal zones. Nonetheless, the sender gauge 74 may be disposed in any one of the other equal zones. Although the reservoir 36 includes four of the rod sockets 60 and one of the line socket 86 cooperating to define five equal zones, any number of rod and line sockets may be included to define any number of equal zones.

In addition, the inner wall 68 includes retaining features 100, such as protrusions, configured to retain the core components, including the main pump 38 and the main filter 40. For example, the main pump 38 and the main filter 40 may be coupled to brackets 102, which may be slid over the retaining features 100 to create a snap fit that retains the main pump 38 and the main filter 40 to the inner wall 68. Since the core components are attached to the inner wall 68 rather than the outer wall 66, attaching the core components to the reservoir 36 does not require brackets that extend from the core components to the outer wall 66. Thus, the sender gauge 74 and/or the auxiliary pump 76 may be disposed in any one of the equal zones without interfering with such brackets.

In this regard, the fuel pump module 20 includes various features providing flexibility to satisfy packaging constraints within the fuel tank 18 of FIG. 3 without redesigning the fuel pump module 20. These various features include the alternate positioning of the reservoir 36 relative to the flange 30, the alternate positioning of the arm 80, the equal zones containing the universally configured supports 72, and the attachment of the core components to the inner wall 68 rather than to the outer wall 66. The flexibility provided by these various features may be utilized to reconfigure the fuel pump module 20 rather than redesigning the fuel pump module 20. In turn, the fuel pump module 20 may be adapted to different vehicle applications at a reduced cost.

Figure 10:
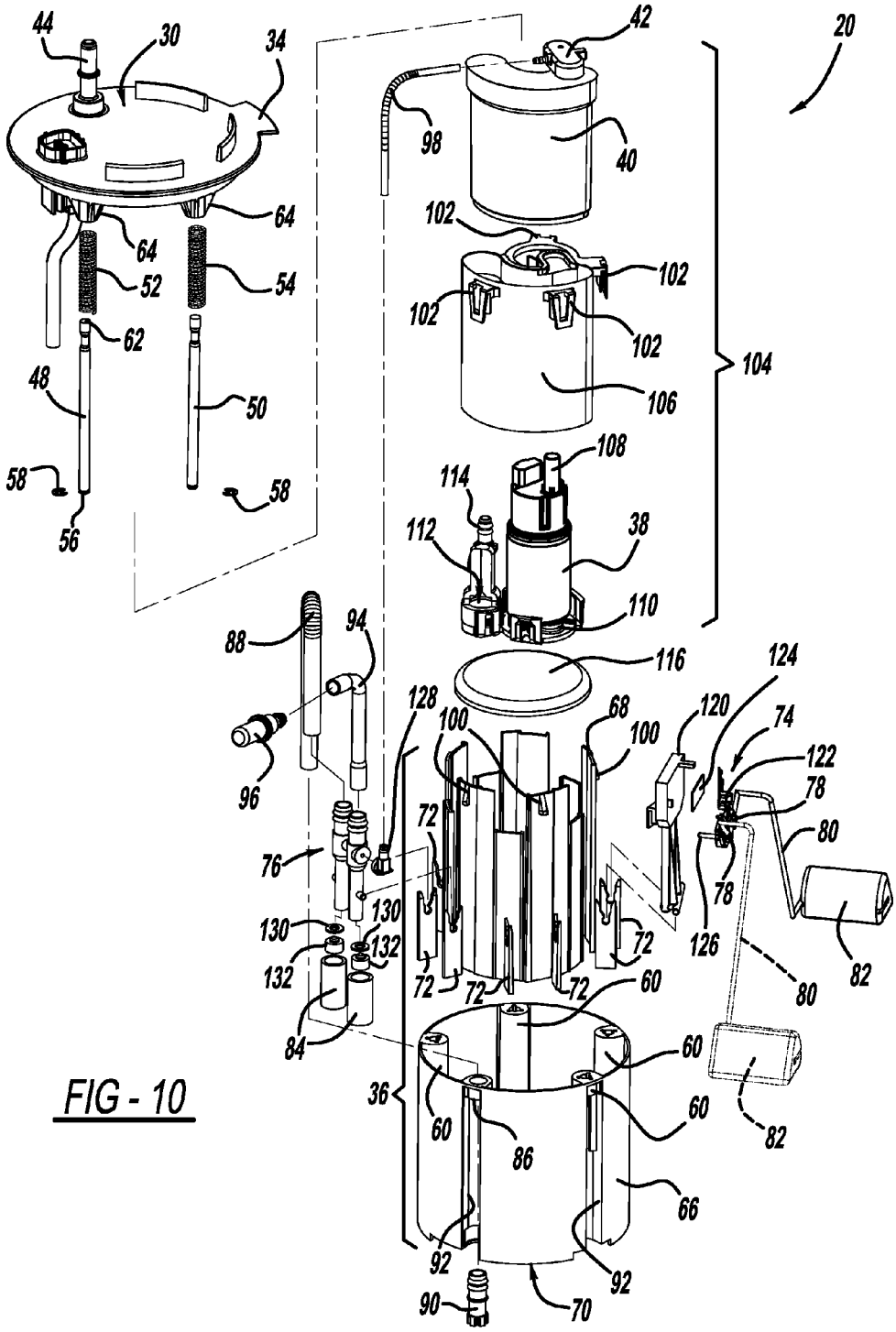
FIG. 10 is an exploded view of the fuel pump module of FIG. 4 depicting the components of the fuel pump module.

Referring now to FIG. 10, the main pump 38, the main filter 40, and the check valve 42 may be part of a pump and filter assembly 104. The pump and filter assembly 104 may include a housing 106 that houses the main pump 38 and the main filter 40, and that couples the main pump 38, the main filter 40, and the check valve 42 to the reservoir 36. The housing 106 includes the brackets 102 that may be slid over the retaining features 100 to create a snap fit that secures the main pump 38, the main filter 40, and the check valve 42 to the inner wall 68 of the reservoir 36. The main filter 40 and the check valve 42 may be inserted through the upper end of the housing 106, and the main pump 38 may be inserted through the lower end of the housing 106.

The upper end of the main pump 38 includes a connection 108 that connects the main pump 38 to the check valve 42. The lower end of the main pump 38 is attached to a bracket 110 that clips onto the outside surface of the housing 106 to secure the main pump 38 to the housing 106. The bracket 110 defines a regulator socket 112, and a pressure regulator (not shown) may be inserted into the regulator socket 112. The pressure regulator may be connected to the fuel supply line port 44 via a line connection 114 coupled to the bracket 110. The main pump 38 draws fuel from within the reservoir 36 through the connection 108, and the main pump 38 pumps fuel to the fuel supply line port 44 through the line connection 114. The pressure regulator may regulate the pressure of fuel pumped from the main pump 38 to the fuel supply line port 44.

Figure 12:
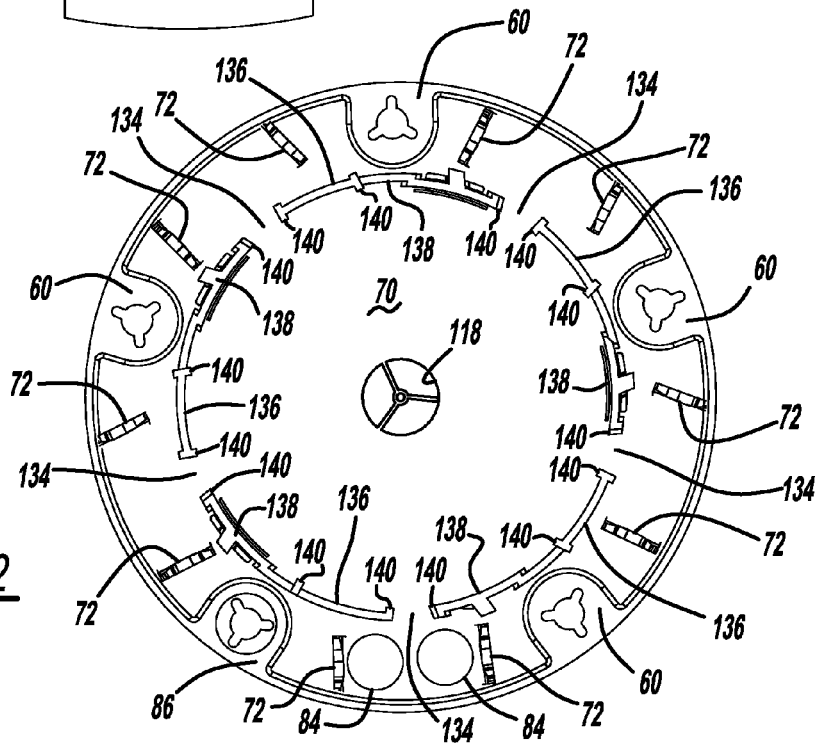
FIG. 12 is a top view of the reservoir of FIG. 11.

With continued reference to FIG. 10, and additional reference to FIG. 12, a suction filter 116 (FIG. 10) is positioned beneath the pump and filter assembly 104 and over an inlet 118 (FIG. 12) defined by the reservoir 36. The suction filter 116 filters fuel entering the reservoir 36 through the inlet 118. An umbrella valve (not shown) may be positioned between the suction filter 116 and the inlet 118. Further discussion of the suction filter 116, the inlet 188, and the umbrella valve may be found in commonly assigned U.S. patent application Ser. No. 13/100,671 (filed on May 4, 2011), which is incorporated by reference herein in its entirety.

With continued reference to FIG. 10, the sender gauge 74 includes a card mount 120 and a contact mount 122. A resistance card 124 is fixed to the card mount 120 such that the length of the resistance card 124 is oriented horizontally. The contact mount 122 includes the arm brackets 78, and the arm 80 is inserted into one of the arm brackets 78. The arm 80 may extend through the contact mount 122, and the portion of the arm 80 extending through the contact mount 122 may form a resistance contact 126. The arm brackets 78 rotate relative to the remainder of the contact mount 122 such that the arm 80 and the resistance contact 126 are pivotally mounted to the contact mount 122.

The contact mount 122 is disposed at least partially within one of the equal zones, the float 82 is disposed outside of the reservoir 36, and the arm 80 extends from the contact mount 122, over the outer wall 66 of the reservoir 36, to the float 82. The card mount 120 is designed to avoid contact with the arm as the arm 80 pivots with the contact mount 122 relative to the card mount 120. In addition, the arm 80 is designed to avoid contact with the reservoir 36 as the arm 80 pivots with the contact mount 122 relative to the card mount 120. Furthermore, the sender gauge 74 is positioned to prevent contact between the arm 80 and the flange 30 when the arm 80 is completely raised.

In operation, the float 82 raises and lowers in response to changes in the fuel levels of the fuel tank 18 of FIG. 3. As the float 82 raises and lowers, the arm 80 and a portion of the contact mount 122 including the arm brackets 78 rotate relative to the remainder of the contact mount 122 and the card mount 120. In turn, the resistance contact 126 travels through a radius along the length of the resistance card 124. The sender gauge 74 detects changes in fuel levels based on changes in the resistance between the resistance card 124 and the resistance contact 126 as the resistance contact 126 travels through the radius along the length of the resistance card 124.

The resistance contact 126 travels in a first direction along the length of the resistance card 124 when the arm 80 is raised while fixed to a first one of the arm brackets 78. The resistance contact 126 travels in a second direction along the length of the resistance card 124 when the arm 80 is raised while the arm 80 is fixed to a second one of the arm brackets 78. The second direction is generally opposite from the first direction.

Since the resistance card 124 is oriented horizontally, the pivot point of the arm 80 may be positioned below the resistance card 124 approximately midway along the length of the resistance card. Also, the arm 80 may be assembled in either one of the two positions shown in FIG. 10 while still allowing the resistance contact 126 to sweep through the radius along the length of the resistance card 124. In contrast, in sender gauges having a resistance card oriented vertically, the pivot point is generally located beside the resistance card approximately midway along the length of the resistance card. Also, the arm may only be assembled in a single position while still allowing the resistance contact to travel through a radius along the length of the resistance card.

When the arm 80 is switched from the primary position represented in solid lines to the alternate position represented in dashed lines, the resistance card 124 may be replaced with a second resistance card (not shown) corresponding to the alternative position. Alternatively, a controller (not shown) in communication with the sender gauge 74 may have different settings for interpreting the output of the sender gauge 74 depending upon the positioning of the arm 80. In either case, the sender gauge 74 accurately indicates fuel levels in the fuel tank 18 of FIG. 3 regardless of the positioning of the arm 80.

With continued reference to FIG. 10, the auxiliary pump 76 includes a line connection 128 that connects to the feed line 98. In addition, seals 130 and floats 132 may be disposed at or near the lower end of the auxiliary pump 76 within the prime sockets 84 of the reservoir 36. The main pump 38 primes the auxiliary pump 76 by drawing fuel from the prime sockets 84, through the auxiliary pump 76, and through the feed line 98. This creates a vacuum within the auxiliary pump 76, enabling the auxiliary pump 76 to rely on the Venturi effect to draw fuel through the pickup line 88 and the transfer line 94 from various locations within the fuel tank 18 of FIG. 3.

Fuel entering the auxiliary pump 76 forces the seals 130 and the floats 132 downward into the prime sockets 84, allowing fuel to exit the auxiliary pump 76 through the lower end of the auxiliary pump 76. Otherwise, when fuel is not drawn into the auxiliary pump 76, the floats 132 force the seals 130 against the lower end of the auxiliary pump 76 to create a seal. This seal prevents fuel within the reservoir 36 from flowing through the lower end of the auxiliary pump 76 and to locations outside of the reservoir 36. In this regard, the seals 130 and the floats 132 form a check valve that allows fuel flow into the reservoir 36 through the lower end of the auxiliary pump 76 and prevents fuel flow out of the reservoir 36 through the lower end of the auxiliary pump 76.

Figure 11:
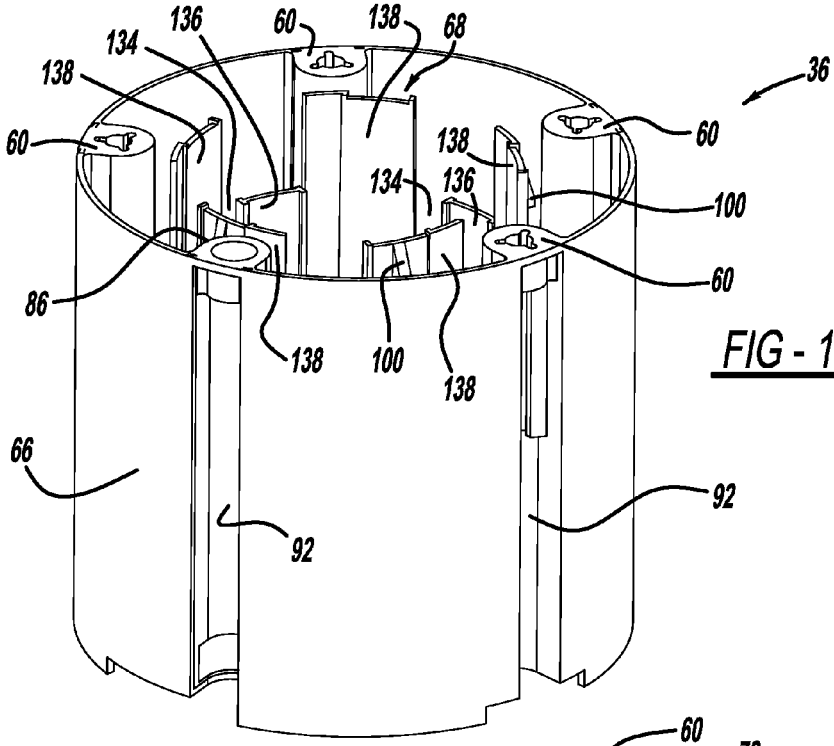
FIG. 11 is a perspective view of a reservoir included in the fuel pump module of FIG. 4 depicting an inner wall defining an inner zone and an outer zone.

Referring now to FIGS. 11 and 12, with continued reference to FIG. 10, the outer wall 66, the inner wall 68, the floor 70, the supports 72, and the prime sockets 84 can be integrally formed or separately formed and attached together. The floor 70 defines the inlet 118, which is disposed radially inward relative to the inner wall 68 at the center of the reservoir 36. Notwithstanding the different configuration of the line socket 86 relative to the rod socket 60 and the inclusion of only one set of the prime sockets 84, the reservoir 36 is symmetric around the longitudinal axis extending through the center of the reservoir 36.

The flexibility of the fuel pump module 20 is provided in part by the symmetry of the reservoir 36 and the positioning of the inlet 118. The symmetry of the reservoir 36 enables mounting the sender gauge 74 within any one of the equal zones disposed around the perimeter of the reservoir other than the equal zone in which the prime sockets 84 are disposed. The positioning of the inlet 118 enables repositioning the auxiliary pump 76 by rotating the reservoir 36 about the longitudinal axis extending through the center of the reservoir 36.

The inner wall 68 defines a plurality of vertical slots 134 that divide the inner wall 68 into a plurality of sections equal in number to the number of equal zones. The sections each include a first subsection 136 and a second subsection 138. The height of the first subsections 136 is less than the height of the second subsections 138. The outer surface of the second subsections 138 define the retaining features 100 that retain the pump and filter assembly 104. Flanges 140 abut each end of the first and second subsections 136, 138. The upper edges of the first subsections 136 and the flanges 140 cooperate to align, support, and retain the sender gauge 74, as discussed in more detail below.

Figure 13:
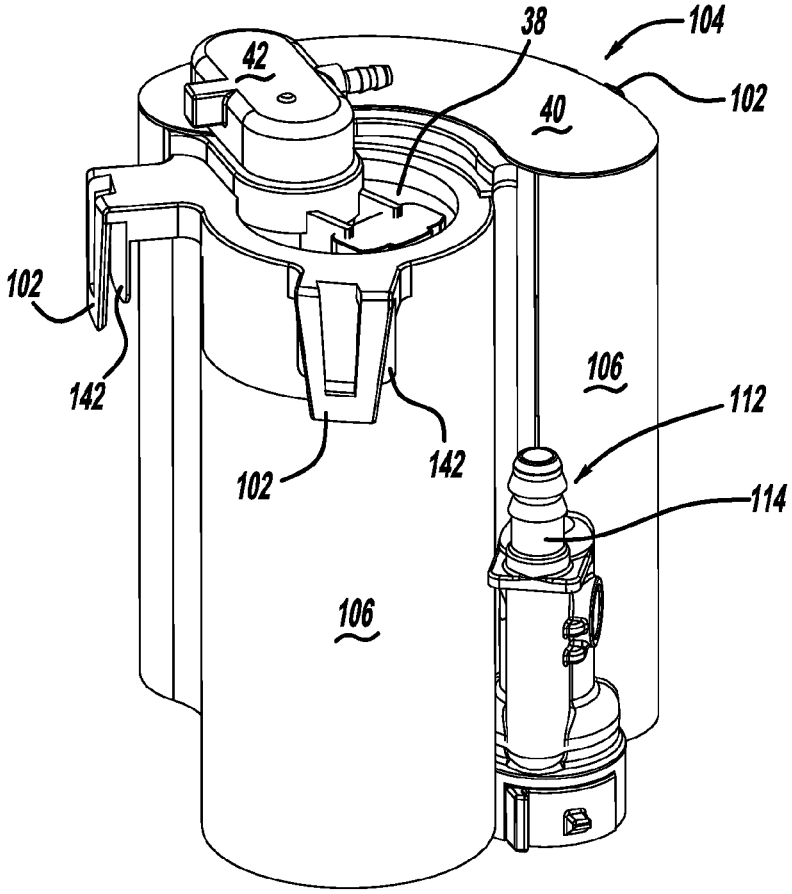
FIG. 13 is a perspective view of a pump and filter assembly included in the fuel pump module of FIG. 4 depicting brackets for attachment to the inner wall of the reservoir of FIG. 11.
Figure 14:
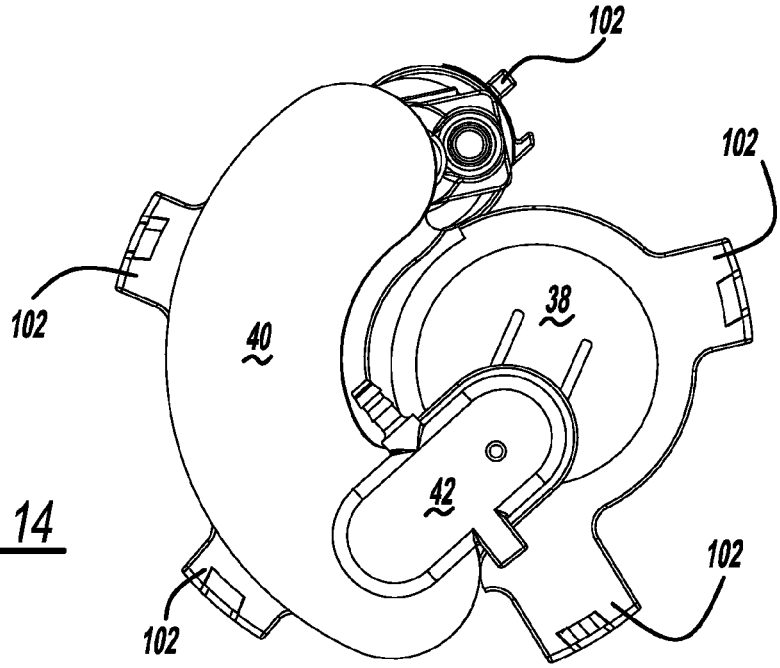
FIG. 14 is a top view of the pump and filter assembly of FIG. 13.
Figure 15:
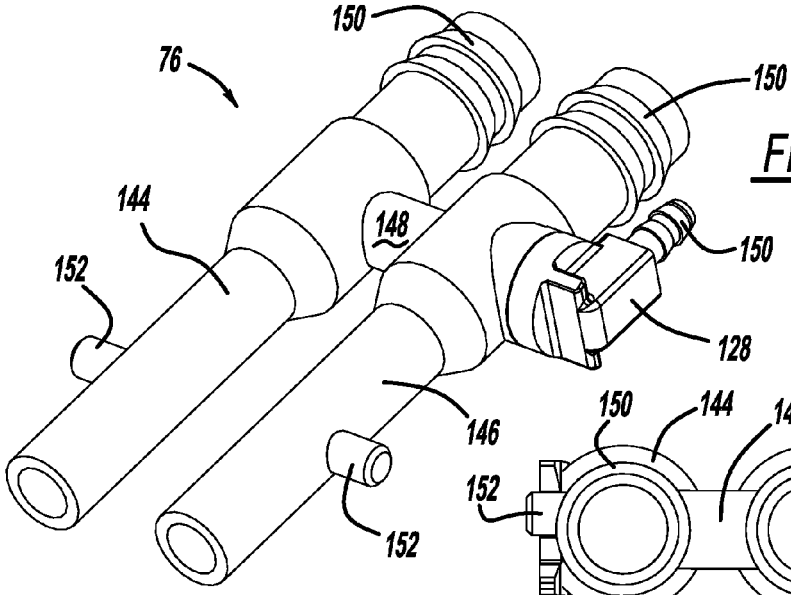
FIG. 15 is a perspective view of an auxiliary pump included in the fuel pump module of FIG. 4.

Referring now to FIGS. 13 and 14, with continued reference to FIG. 10, the housing 106 includes multiple tabs 142 disposed radially inward relative to the brackets 102 of the housing 106. The tabs 142 engage the inner surface of the inner wall 68 as the brackets 102 are slid over the retaining features 100 on the outer surface of the inner wall 68. Thus, the inner wall 68 is positioned between the brackets 102 and the tabs 142 when the pump and filter assembly 104 is attached to the inner wall 68. The brackets 102 and the tabs 142 are equally spaced around the perimeter of the pump and filter assembly 104 so that the reservoir 36 can be rotated relative to the pump and filter assembly 104 to reposition the auxiliary pump 76.

Referring now to FIGS. 15 through 18, with continued reference to FIG. 10, the auxiliary pump 76 includes the line connection 128, a first tube 144, a second tube 146, a third tube 148. The line connection 128 is attached to the outer side of the second tube 146. The first tube 144 and the second tube 146 extend axially. The third tube extends horizontally and connects the first tube 144 and the second tube 146. The upper ends of the first tube 144, the second tube 146, and the line connection 128 each include line-engaging features 150, such as ridges, which engage fuel lines to secure the fuel lines to the auxiliary pump 76. The auxiliary pump 76 also includes bosses 152 that extend horizontally from the outer sides of the first and second tubes 144, 146.

Figure 16:
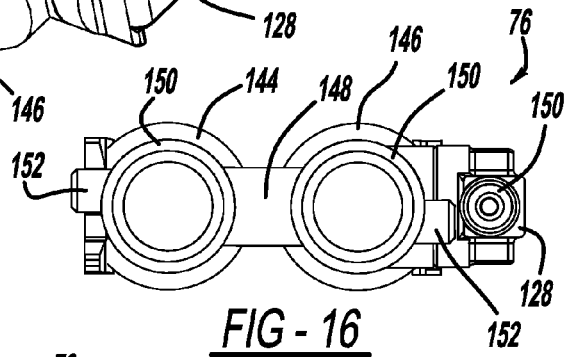
FIG. 16 is a top view of the auxiliary pump of FIG. 15.

The bosses 152 are inserted into vertical slots 154 defined in the supports 72 to mount the auxiliary pump 76 to the reservoir 36. As best shown in FIG. 16, the bosses 152 are radially offset relative to one another to prevent the bosses 152 from sliding out of the vertical slots 154 due to rotation of the auxiliary pump 76 about a radial axis of the auxiliary pump 76. Thus, the offset bosses 152 are used to retain the auxiliary pump 76 in the supports 72.

Figure 17:
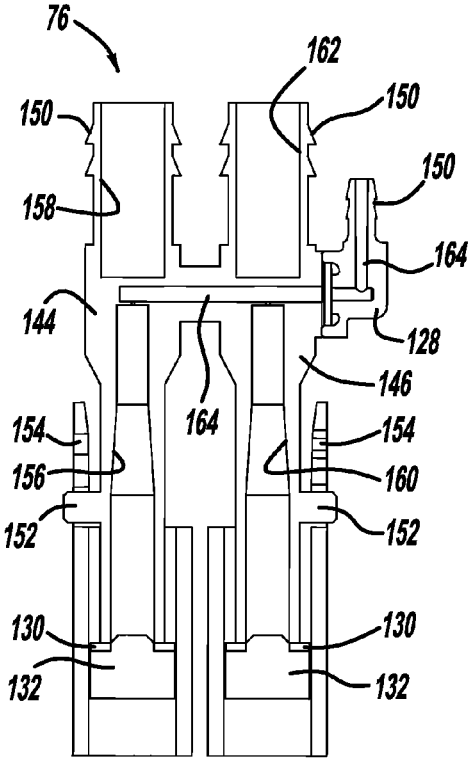
FIG. 17 is a section view of the auxiliary pump of FIG. 15 depicting a check valve in a closed position that prevents fuel flow through the auxiliary pump.
Figure 18:
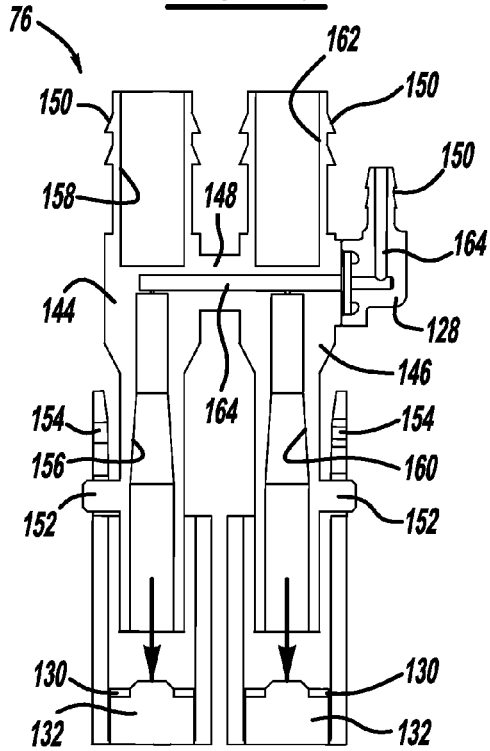
FIG. 18 is a section view of the auxiliary pump of FIG. 15 depicting the check valve in an open position that allows fuel flow through the auxiliary pump.

As best shown in FIGS. 17 and 18, the inner surface of the first tube 144 defines a first nozzle 156 and a first cylindrical passage 158, and the inner surface of the second tube 146 defines a second nozzle 160 and a second cylindrical passage 162. An orifice 164 provides fluid communication between the first tube 144, the second tube 146, and the line connection 128. The orifice 164 is disposed between the first nozzle 156 and the first cylindrical passage 158 and between the second nozzle 160 and the second cylindrical passage 162.

When fuel is not flowing through the auxiliary pump 76 or when a vacuum is initially created within the auxiliary pump 76, the seals 130 and the floats 132 engage the lower end of the auxiliary pump 76 to prevent fuel from flowing through the lower end of the auxiliary pump 76, as best shown in FIG. 17. As the vacuum draws fuel through the upper end of the auxiliary pump 76, the fuel forces the seals 130 and the floats 132 downward into the prime boxes 84. This allows the fuel to enter the reservoir 36 through the lower end of the auxiliary pump 76, as best shown in FIG. 18.

Figure 19:
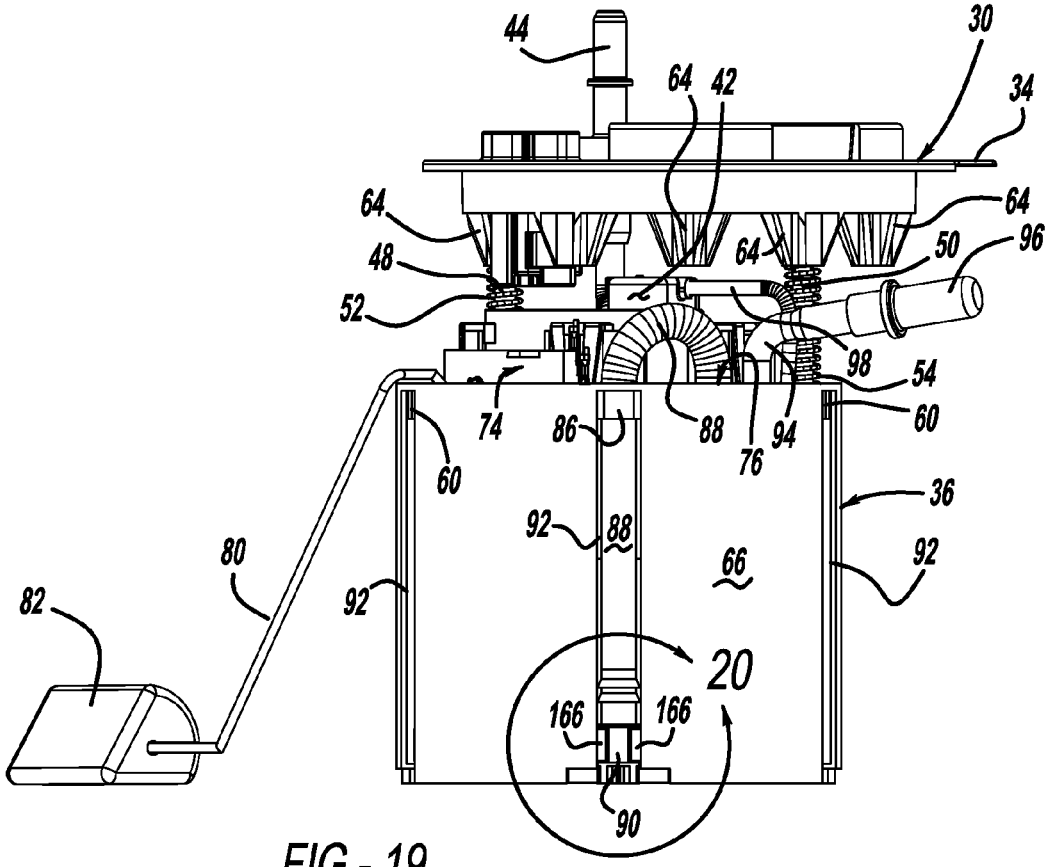
FIG. 19 is a side view of the fuel pump module of FIG. 4 depicting an auxiliary filter through which fuel flows before reaching the auxiliary pump of FIG. 15.
Figure 20:
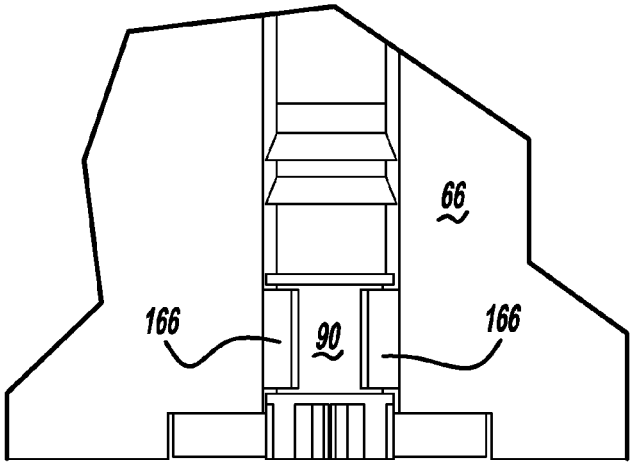
FIG. 20 is a close up view of a portion of FIG. 19 within a line 20.

Referring now to FIGS. 19 and 20, the outer wall 66 of the reservoir 36 includes retaining features 166, such as tabs, disposed in one of the grooves 92 extending axially along the length of the outer wall 66. The auxiliary filter 90 is inserted between the retaining features 166, and the retaining features 166 engage the auxiliary filter 90 to create a snap fit that secures the auxiliary filter 90 against the outer wall 66. The auxiliary filter 90 may filter fuel drawn through the pickup line 88 by the auxiliary pump 76. Alternatively, the auxiliary filter 90 may be replaced with a simple inlet port (not shown) that does not filter fuel as the auxiliary pump 76 draws the fuel through the pickup line 88.

Figure 21:
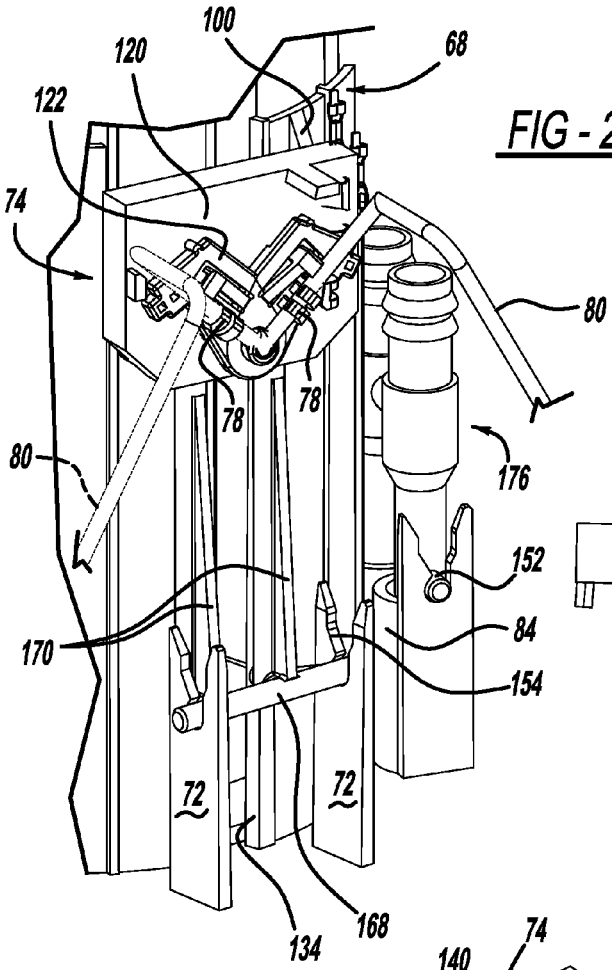
FIG. 21 is a perspective view of a portion of the fuel pump module of FIG. 4 depicting a lower end of a sender gauge mounted within a reservoir.
Figure 22:
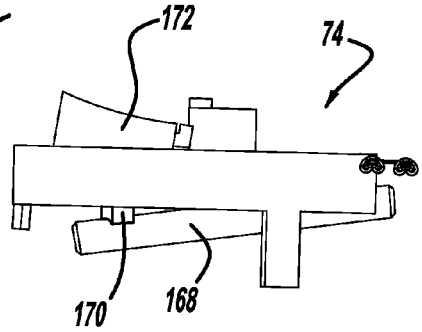
FIG. 22 is a top view of the sender gauge of FIG. 21.
Figure 23:
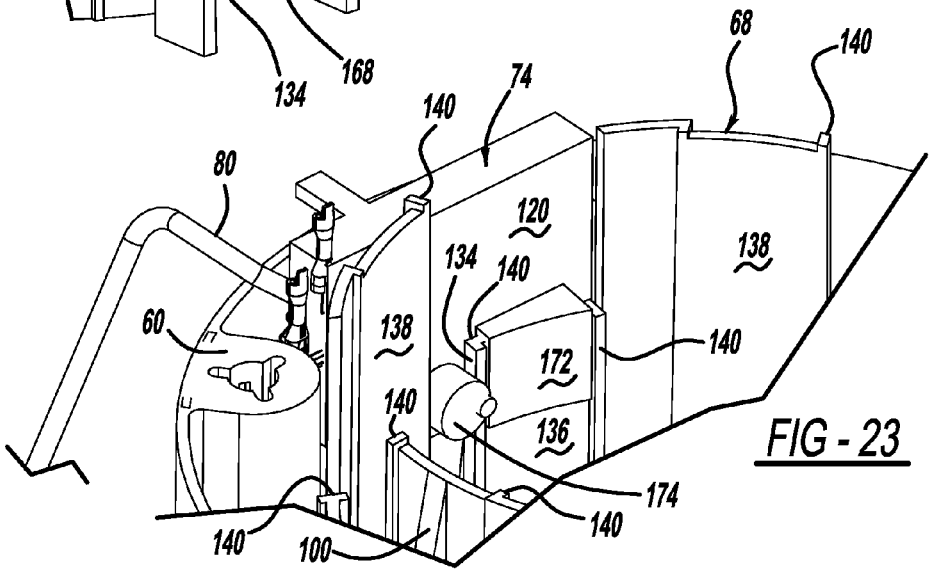
FIG. 23 is a perspective view a portion of the fuel pump module of FIG. 4 depicting an upper end of the sender gauge of FIG. 21 mounted to the inner wall of the reservoir shown in FIG. 11.

Referring now to FIGS. 21 through 23, the sender gauge 74 includes a boss or rod 168 disposed at the lower end of the sender gauge 74, and legs 170 connecting the rod 168 to the card mount 120. As best shown in FIG. 21, the rod 168 extends horizontally and the legs 170 extend axially when the sender gauge 74 is mounted within the reservoir 36. The vertical slots 154 in the support 72 may be V-shaped and may be configured to create a snap fit between the supports 72 and the rod 168. As best shown in FIG. 22, the ends of the rod 168 are radially offset from one another to match the radial offset between the vertical slots 154 in the supports 72. This radial offset prevents the rod 168 from sliding out of the vertical slots 154 due to rotation of the sender gauge 74.

As best shown in FIG. 23, the sender gauge 74 includes a bracket 172 and a boss 174 that extend radially inward from the card mount 120. When the sender gauge 74 is assembled to the inner wall 68, the bracket 172 is placed over one of the first subsections 136, and the boss 174 is inserted into the adjacent one of the vertical slots 134. The bracket 172 is L-shaped and is configured to wrap around the top edge of the inner wall 68 to create a press fit between the sender gauge 74 and the inner wall 68. The flanges 140 at the edges of the first subsection 136 engage the sides of the bracket 172, and the flanges 140 defining the vertical slot 134 engage the sides of the boss 174. This engagement aligns the sender gauge 74 relative to the inner wall 68.

Figure 24:
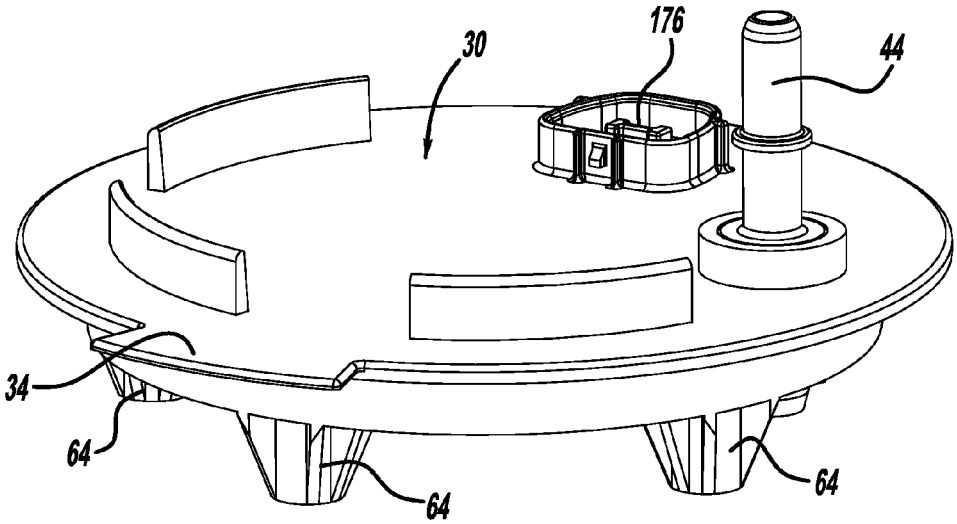
FIG. 24 is a perspective view of a flange included in the fuel pump module of FIG. 4 depicting sockets for receiving rods and a hose included in the fuel pump module.
Figure 25:
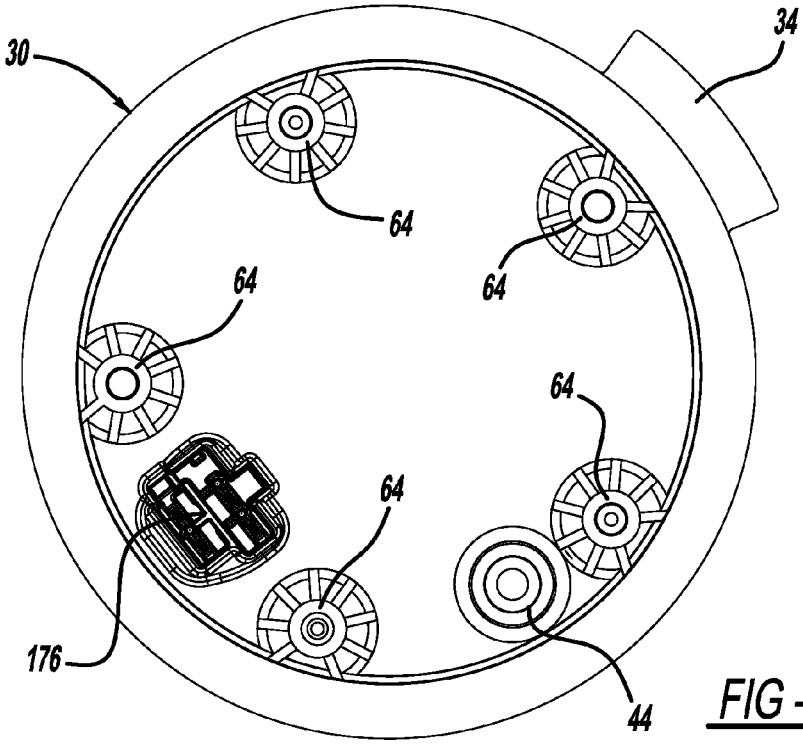
FIG. 25 is a bottom view of the flange of FIG. 24.

Referring now to FIGS. 24 and 25, the flange 30 includes an electrical connection 176. The control module may communicate with the fuel pump module via the electrical connection 176. In this manner, the control module may control operation of the main pump 38 and the check valve 42, and the control module may receive a fuel level signal from the sender gauge 74. The rod sockets 64 are equally spaced around the perimeter of the flange 30 to correspond to the equal spacing between the rod sockets 60 in the reservoir 36 of FIG. 11. As indicated above, this equal spacing enables rotation of the reservoir 36 relative to the flange 30 to satisfy packaging requirements.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel pump module, comprising:

a reservoir including an outer wall, an inner wall spaced radially inward from the outer wall, and at least three through-hole sockets spaced around a perimeter of the reservoir to define at least three zones between the inner and outer walls;

a sender gauge mounted to the reservoir and configured to be contained in any one of the at least three zones.

2. The fuel pump module of claim 1, wherein the at least three zones include five zones.

3. The fuel pump module of claim 1, further comprising an auxiliary pump disposed in any one of the at least three zones, excluding the one of the at least three zones containing the sender gauge.

4. The fuel pump module of claim 3, wherein the reservoir includes supports disposed in each of the at least three zones and configured to support at least one of the sender gauge and the auxiliary pump.

5. The fuel pump module of claim 4, wherein the at least one of the sender gauge and the auxiliary pump includes a boss extending horizontally, and the supports define slots configured to receive and retain the boss.

6. The fuel pump module of claim 3, wherein the auxiliary pump is an eductor-jet pump.

7. The fuel pump module of claim 6, wherein:

the reservoir includes a prime socket disposed in any one of the at least three zones, excluding both the one of the at least three zones containing the sender gauge and the one of the at least three zones containing the auxiliary pump, and configured to contain fuel to prime the auxiliary pump; and a lower end of the auxiliary pump is disposed in the prime socket.

8. The fuel pump module of claim 7, wherein the through-hole sockets include a line socket adjacent to the prime socket and adapted to receive a first line routed from the auxiliary pump to an auxiliary filter mounted to the reservoir at a first position in a fuel tank outside of the reservoir.

9. The fuel pump module of claim 8, wherein the through-hole sockets include a rod socket configured to receive a rod coupling the reservoir to the fuel tank, the line socket having a first inner diameter and the rod socket having a second inner diameter that is less than the first inner diameter.

10. The fuel pump module of claim 8, wherein the reservoir includes a retaining feature on an outer surface of the outer wall that retains the auxiliary filter.

11. The fuel pump module of claim 8, wherein: the auxiliary pump includes first and second tubes and a line connection in fluid communication with the first and second tubes; an upper end of the first tube is configure to engage the first line; an upper end of the second tube is configured to engage a second line routed to a second position in the fuel tank outside of the reservoir; and the line connection is configured to engage a third line is routed to an electric pump.

12. The fuel pump module of claim 11, further comprising a check valve disposed at the lower end of the auxiliary pump and adapted to prevent fuel flow through the auxiliary pump from the prime socket.

13. The fuel pump module of claim 1, further comprising a main pump;

a main filter; and a housing, which houses the main pump and the main filter, wherein the inner wall divides the reservoir into an inner zone contained within the inner wall, and the at least three zones between the outer and inner walls, and the main pump, the main filter, and the housing are contained in the inner zone and disposed radially inward from and mounted to the inner wall.

14. The fuel pump module of claim 1, wherein a floor of the reservoir defines an inlet disposed radially inward from the inner wall.

15. The fuel pump module of claim 1, further comprising:

a flange configured to mount to a top surface of a fuel tank, the flange including flange sockets disposed around a perimeter of the flange; and a rod coupling the reservoir to the flange and having one end inserted into the flange sockets and another end inserted into the through-hole sockets.

16. A fuel pump module, comprising:

a reservoir configured to contain fuel, the reservoir including an outer wall, an inner wall spaced radially inward from the outer wall, sockets spaced around a perimeter of the reservoir to define at least three zones between the inner wall and the outer wall, and supports disposed in each of the at least three zones; and a sender gauge including a horizontal rod at a lower end of the sender gauge and an L-shaped bracket adjacent to an upper end of the sender gauge, wherein the L-shaped bracket is wrapped around a top edge of the inner wall and the inner wall includes flanges engaging sides of the L-shaped bracket, the supports defining slots that support and retain the horizontal rod using a snap fit, wherein the sender gauge is mounted to the reservoir and configured to be contained in any one of the at least three zones.

17. A reservoir for a fuel pump module, comprising:

an outer wall extending around a perimeter of the reservoir;

an inner wall spaced radially inward from the outer wall; and sockets disposed around the perimeter of the reservoir along the outer wall and defining at least three zones between the inner wall and the outer wall, wherein the sender gauge is mounted to the reservoir and configured to be contained in any one of the at least three zones.

18. The reservoir of claim 17, wherein a floor of the reservoir defines an inlet disposed radially inward from the inner wall.

19. The reservoir of claim 17, wherein the reservoir includes supports disposed in each of the at least three zones and configured to support at least one of a sender gauge and an auxiliary pump.

20. The reservoir of claim 17, wherein the reservoir includes a prime socket disposed on a floor of the reservoir in one of the at least three zones and configured to contain fuel to prime an eductor-jet pump.

21. The fuel pump module of claim 13, wherein the inner wall defines at least three vertical slots that divide the inner wall into at least three sections correspondingly to the at least three zones, and the at least three zones communicate with the inner zone through the at least three sections.

22. The fuel pump module of claim 21, further comprising:

two rods coupling the reservoir to the fuel tank, wherein the at least three through-hole sockets include a first rod socket, a second rod socket, and a third rod socket, the first rod socket and one of the second rod socket and the third rod socket are configured to receive the two rods, respectively, such that the reservoir is radially offset by a first distance relative to the flange, and the first rod socket and the other one of the second rod socket and the third rod socket are configured to receive the two rods, respectively, such that the reservoir is radially offset by a second distance relative to the flange, the second distance being greater than the first distance.

23. The fuel pump module of claim 16, further comprising:

a main pump; a main filter; and a housing, which houses the main pump and the main filter, two rods coupling the reservoir to the fuel tank, wherein the inner wall divides the reservoir into an inner zone contained within the inner wall, and the at least three zones between the outer and inner walls, the main pump, the main filter, and the housing are contained in the inner zone and disposed radially inward from and mounted to the inner wall, the inner wall defines at least three vertical slots that divide the inner wall into at least three sections correspondingly to the at least three zones, the at least three zones communicate with the inner zone through the at least three sections, the at least three through-hole sockets include a first rod socket, a second rod socket, and a third rod socket, the first rod socket and one of the second rod socket and the third rod socket are configured to receive the two rods, respectively, such that the reservoir is radially offset by a first distance relative to the flange, and the first rod socket and the other one of the second rod socket and the third rod socket are configured to receive the two rods, respectively, such that the reservoir is radially offset by a second distance relative to the flange, the second distance being greater than the first distance.

* * * * *

UNITED STATES PATENT AND TRADEMARK OFFICE

CERTIFICATE OF CORRECTION

PATENT NO. : 8,616,184 B2
APPLICATION NO. : 13/118967
DATED : December 31, 2013
INVENTOR(S) : Patrick Powell It is certified that error appears in the above-identified patent and that said Letters Patent is hereby corrected as shown below:

In the Specifications

Col. 3, line 43, before “a” insert --of--;

Col. 5, line 24, after “of” delete “the”;

Col. 10, line 32, delete “boxes” and insert --sockets--;

In the Claims

Col. 11, Claim 1, line 32, after “including”, insert --:--;

Col. 12, Claim 11, line 11, after “wherein:”, insert --¶ break--;

Col. 12, Claim 11, line 13, after “tubes;”, insert --¶ break--;

Col. 12, Claim 11, line 14, delete “configure” and insert --configured--;

Col. 12, Claim 11, line 14, after “line;”, insert --¶ break--;

Col. 12, Claim 11, line 17, after “and”, insert --¶ break--;

Col. 12, Claim 13, line 23, after “comprising”, insert --:--;

Col. 12, Claim 13, line 25, after “and”, insert --¶ break--;

Col. 13, Claim 21, line 14, after “wherein”, insert --:--;

Col. 14, Claim 23, line 5, after “pump;”, insert --¶ break--; and,

Col. 14, Claim 23, line 5, after “and”, insert --¶ break--.

Signed and Sealed this
Sixth Day of May, 2014

Michelle K. Lee

Michelle K. Lee
*Deputy Director of the United States Patent and Trademark Office*